US010984767B2

(12) United States Patent
Steinhauser

(10) Patent No.: US 10,984,767 B2
(45) Date of Patent: Apr. 20, 2021

(54) DRUM WITH SELF-ALIGNING SNARE

(71) Applicant: DRUM WORKSHOP, INC., Oxnard, CA (US)

(72) Inventor: Ruben Steinhauser, Altusried (DE)

(73) Assignee: DRUM WORKSHOP, INC., Oxnard, CA (US)

( * ) Notice: Subject to any disclaimer, the term of this patent is extended or adjusted under 35 U.S.C. 154(b) by 228 days.

(21) Appl. No.: 15/872,650

(22) Filed: Jan. 16, 2018

(65) Prior Publication Data

US 2018/0204550 A1 Jul. 19, 2018

Related U.S. Application Data

(60) Provisional application No. 62/447,356, filed on Jan. 17, 2017.

(51) Int. Cl.

| | |
|---|---|
| ***G10D 13/02*** | (2020.01) |
| ***G10D 13/18*** | (2020.01) |
| *G10D 13/20* | (2020.01) |
| *G10D 13/22* | (2020.01) |

(52) U.S. Cl.
CPC ..... *G10D 13/02* (2013.01); *G10D 13/18* (2020.02); *G10D 13/20* (2020.02); *G10D 13/22* (2020.02)

(58) Field of Classification Search
CPC ... G10D 13/025; G10D 13/027; G10D 13/028
USPC ..... 84/415
See application file for complete search history.

(56) References Cited

U.S. PATENT DOCUMENTS

| | | | | |
|---|---|---|---|---|
| 5,895,873 | A | 4/1999 | Yanagisawa | |
| 7,902,444 | B1 | 3/2011 | Good | |
| 8,141,507 | B2 | 3/2012 | Good | |
| 2002/0178895 | A1 | 12/2002 | Cherbettchian | |
| 2005/0150353 | A1 | 7/2005 | Takecawa | |
| 2005/0188818 | A1 | 9/2005 | Okamoto | |
| 2005/0223875 | A1 * | 10/2005 | Hagiwara | G10D 13/025 84/415 |
| 2014/0174278 | A1 | 6/2014 | Yu | |

OTHER PUBLICATIONS

International Search Report for Application No. PCT/US18/113883; dated May 15, 2018.

* cited by examiner

*Primary Examiner* — Jianchun Qin
(74) *Attorney, Agent, or Firm* — Ferguson Case Orr Paterson

(57) ABSTRACT

A snare drum including a self-alignment component is disclosed. The self-alignment component may be engaged by a tensioning band, which can attach to one end of a snare that contacts or is proximate a bottom drum head. The tensioning band may loop around a part of the self-alignment component, such as an alignment piece thereof. The geometry of the self-alignment component is designed to allow the tensioning band to self-align such that portions on opposing sides of the alignment piece have approximately equal tension therein and/or have approximately equal length, thus allowing for a properly aligned snare on the bottom drum head. The self-alignment component can include a plate portion attached to a drum sidewall or tensioning device on a drum sidewall, and can further include a cover portion for attachment to the plate portion.

23 Claims, 5 Drawing Sheets

DRUM WITH SELF-ALIGNING SNARE

This application claims the priority of U.S. Provisional Pat. App. No. 62/447,356 to Steinhauser, entitled "Drum with Self-Aligning Snare" and filed on Jan. 17, 2017, which is fully incorporated by reference herein in its entirety.

BACKGROUND OF THE DISCLOSURE

Field of the Disclosure

This disclosure relates generally to a drumming device, such as a snare drum, which includes an auxiliary device, such as a snare, which cooperates with a drum body to produce a desired sound, and more particularly relates to alignment and/or positioning of the auxiliary device with respect to the drum body.

Description of the Related Art

Snare drums are commonly used in music to create desired sounds. A snare typically comprises a series of wires that typically connect on one or both ends to a fitting. The snare is on or proximate a bottom drum head of the snare drum and extends substantially across the diameter of the bottom drum head from one end to another. The snare drum comprises a top drum head, which is typically the portion of the snare drum that a user strikes. When the top drum head is actuated (e.g., stricken), the bottom head and snare vibrate to produce the desired sound—the sound typical of a snare drum.

The prior art provides for snare drums that comprise a tensioning adjustment device, such as a handle, and tensioning bands connecting the handle and the end of the snare and/or the snare fitting. Some drums with tensioning adjustment devices and tensioning bands are described in commonly owned U.S. Pat. No. 7,902,444 to Good et al., which is fully incorporated by reference herein in its entirety. When in a first position (typically an "up" position), the handle tensions the tensioning bands such that the snare is proximate and/or contacts the bottom drum head of the snare drum. The handle can also act to loosen the tensioning band, such as when it is placed in a second position (typically a "down" position) such that the snare is no longer proximate and/or no longer contacts the bottom drum head. Such devices are typically referred to as "throw-offs," as a use can simply "throw" the handle into the second/downward position such that the snare is "off" the bottom drum head.

Additionally, commonly owned U.S. Pat. No. 8,143,507 to Good et al., which is fully incorporated by reference herein in its entirety, describes tension adjusting devices including a lever or joystick with more than two positions or a continuous range of positions such that a user can more precisely adjust the tension of the tensioning band, and thus the position of the snare with relation to the bottom drum head. Such a device can be used in conjunction with a "throw-off." For instance, one side of the snare can be connected to a throw-off, the position of which will determine whether actuation of the drum will produce any snare sound, while the other side of the snare can be connected to the more precise adjustment device which can—when the throw-off is in the first/upward position—determine the amount of contact between the snare and the bottom drum head and/or the location of the snare, thus tuning or altering the produced sound.

FIG. 1. is a side view of one embodiment of a prior art snare drum 100. The drum 100 includes a bottom drum head

101, a snare 102 including snare wires 103 and fittings 104, tensioning bands 106 connecting the snare 102 to the remainder/body of the drum, tensioning devices 108, and a drum sidewall 110. The snare wires 103 have two ends and each end is connected to a fitting 104. The fittings 104 are positioned on and/or just below the bottom drum head 101 so that the combination of the bottom drum head 101 and the snare 102 produces the desired sound when a user beats the drum 100. The fittings 104 are connected to the tensioning devices 108*a*,108*c* by the tensioning bands 106 at points 112.

The tension adjusting device 108*a* is a throw-off device as described in U.S. Pat. No. 7,902,444, which tensions the tensioning bands 106 when a user places the handle 108*b* in a first position (shown) or may loosen the tensioning bands 106 when a user places the handle 108*b* in a second, downward position (not shown), producing the desired contact between the snare wires 103 and the bottom drum head 101 when in the first position. The amount of contact between the snare wires 103 and the bottom drum head 101 affects the sounds produced when a user beats the top drum head of the drum 100. The tensioning device 108*c* is a 3-position device as described in U.S. Pat. No. 8,143,507. When the tensioning device 108*a* is in the first position, the amount of contact between the snare wires 103 and the bottom drum head 101 can be fine-tuned by placing the lever or joystick 108*d* in one of three positions, typically by rotating the lever/joystick 108*d* into or out of the page as shown in FIG. 1. Combinations of the different devices are possible, and it is understood that embodiments of the present disclosure may utilize one or both of the tensioning adjusting devices 108*a*,108*c*, may not utilize any tension adjusting devices such as the tension adjusting devices 108*a*,108*c* or may be incorporated into drum designs with other types of tension adjusting devices.

Prior art instruments, while they can adjust the tension in tensioning bands as described above, can often not keep uniform and equal tension across the tensioning bands. Misalignment of portions of the tensioning band and/or differing tensions in the tensioning band portions can cause misalignment of the snare and snare wires, thus producing inconsistent contact between the snare wires and bottom drum head, leading to undesirable and/or inconsistent sounds.

SUMMARY OF THE DISCLOSURE

The present disclosure relates generally to the field of musical drums. The disclosure relates more particularly to devices related to the alignment of snares relative to the snare drum body and/or bottom drum head.

One embodiment of a percussion instrument according to the present disclosure can include a drum body with a drum sidewall and top and bottom drum heads. A snare with first and second fittings and a plurality of snare wires can be in contact with the bottom drum head such that the snare wires vibrate when the top drum head is actuated by a user. The snare wires can be attached on their two ends to the first and second fittings, respectively. The drum can include a self-alignment component on the drum sidewall (with or without another tensioning device therebetween), and can include a plate and a cover attached to the plate, with one of the plate and the cover including an alignment piece. A tensioning band connecting the self-alignment component and the snare can pass between the plate and the cover and engage the alignment piece.

Another embodiment of a percussion instrument according to the present disclosure can include a drum sidewall and a self-alignment component attached to the drum sidewall, the self-alignment component including an alignment piece with a curved surface configured to be engaged by a tensioning band attached to a snare and further configured such that portions of the tensioning band on opposing sides of the first alignment piece and between the first alignment piece and the snare self-align so as to have approximately equal tension and/or length.

One embodiment of a self-alignment component for attachment to a sidewall of a drum according to the present disclosure can be designed for engagement by a tensioning band attached to a snare. The self-alignment component can include a plate configured to be attached to a drum sidewall and a cover for attachment to the plate, with the cover configured to attach to the plate so as to form a channel through which a tensioning band can pass. One of the plate and cover can include an alignment piece having a curved surface for engagement by the tensioning band.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further features and advantages, will be better understood from the following description when considered in connection with the accompanying figures. It is to be expressly understood, however, that each of the figures is provided for the purpose of illustration and description only and is not intended as a definition of the limits of the present disclosure.

DETAILED DESCRIPTION OF THE DISCLOSURE

Figure 1:
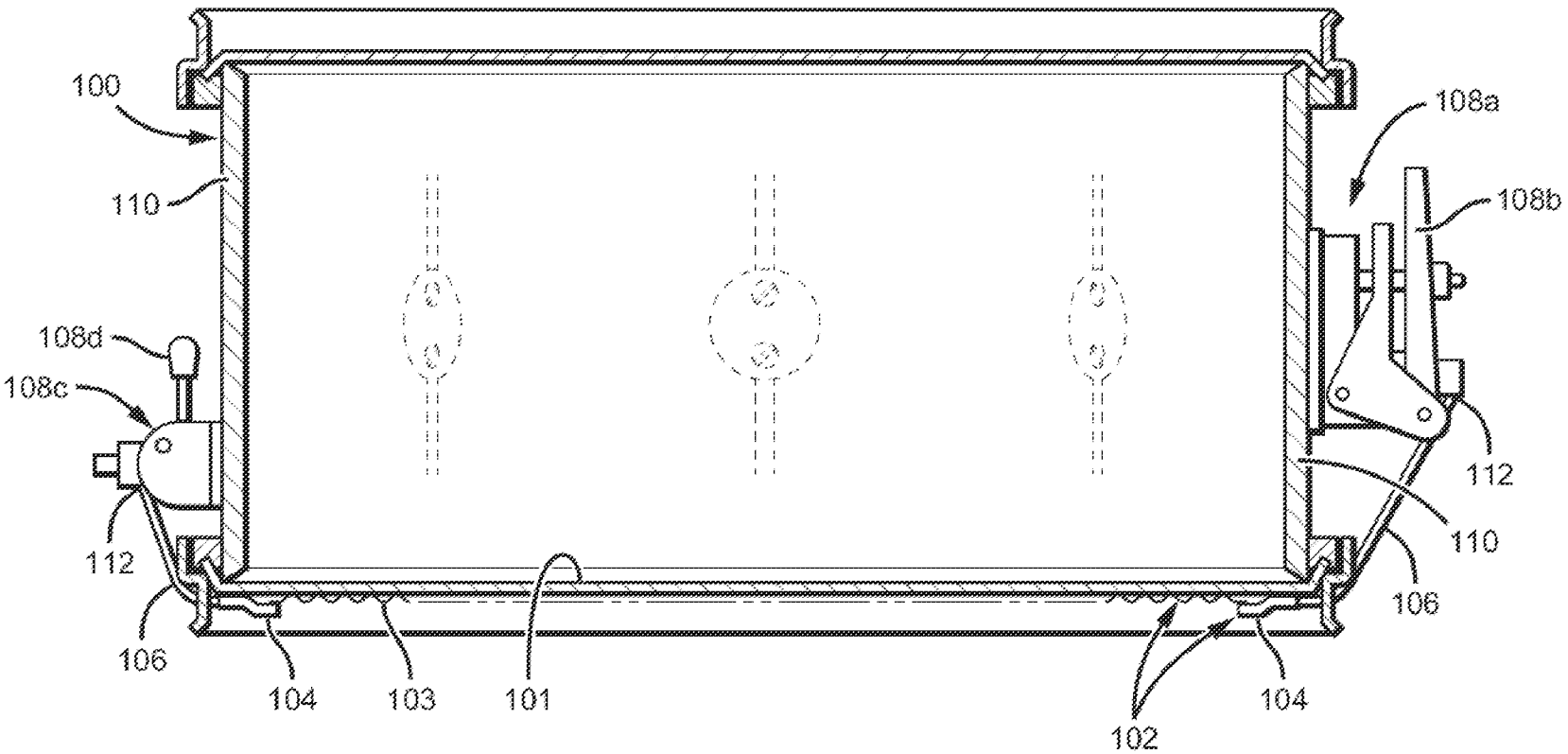
FIG. 1 PRIOR ART
FIG. 1 is a side view of a prior art snare drum.

The present disclosure relates to percussion instruments and drums, and particularly to snare drums, although it is understood that the concepts, components, systems, and methods described herein can be applied to other instruments. Drums according to the present disclosure can include features to produce a self-aligning snare and snare wires. The snare wires may be attached on one or both ends to fittings positioned on or near a bottom drum head such that the snare wires engage, contact, or are proximate the bottom drum head, producing vibration resulting in desired sounds when a user beats a top drum head of the drum. Each tensioning band may be connected with a snare fitting and an alignment piece, attaching and/or looping around the alignment piece to keep the tension substantially equal and uniform throughout the operative part of the tensioning band (and its two portions, divided by the alignment piece), keeping the length of the two portions (as measured between the alignment piece and the connection point with the snare) substantially equal, and creating the desired contact between the snare wires and the bottom drum head. The position of the snare and snare wires can thus self-correct via the tensioning bands and alignment pieces. Use of an alignment piece can also substantially vertically align the snare wires across the diameter of the bottom drum head from one fitting to another, so as to prevent skewing of the snare where only some of the snare wires may be in contact with the bottom drum head while other snare wires are not. The alignment piece can be located equidistant from the desired connection points where the tensioning band portions are connected to the snare.

It is understood that when an element is referred to as being "on" another element, it can be directly on the other element or intervening elements may also be present. Similarly, if an element is "attached to," "connected to," or similar, another element, it can be directly attached/connected to the other element or intervening elements may also be present. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular and/or relative relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present disclosure.

Embodiments of the disclosure are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the disclosure.

FIGS. 2A-2C and 3 show one embodiment of a drum 200 according to the present disclosure. The drum 200 includes a throw-off device 202 attached to a drum body 201. The throw-off device 202 can be similar in many respects, such as in componentry and function, to the throw-off device 108*a* described with regard to FIG. 1. The throw-off device 202 can comprise a base 204, a support arm 206, a throw-off handle 208*b*, and an alignment piece 312. A tensioning band 210, including tensioning band portions 210*a*,210*b*, can be attached to the throw-off device 202 and/or to the alignment piece 312 (seen best in FIG. 3), such as the tensioning band 210 being looped around the alignment piece 312 with the alignment piece 312 dividing the tensioning band 210 into portions 210*a*,210*b*. The base 204 can connect the rest of the throw-off device 202 to the sidewall 201. The connection can be with fasteners such as jackscrews or an adhesive such as glue, or another fastening means as known in the art. The support arm 206 can be provided outwardly from the base 204, and can be operatively connected with the base 204, such as by a pin member, whereby the support arm 206 can pivot or can be stationary. The throw-off handle 208*b* can be operatively and/or pivotally connected to the support arm 204 and/or another portion of the throw-off device 202, such as by another pin member. The throw-off handle 208*b* can also be connected with, or connectable to, the tensioning band 210, such as via the alignment piece 312 (further described below). The alignment piece 312 may be connected with the throw-off handle 208 by connectors such as, for example, threaded fasteners, may be integral with the throw-off handle 208 and/or another portion of the throw-off device 202, and/or may be part of the throw-off handle 208 and/or another portion of the throw-off device 202. Many different manners of connecting the throw-off device 202 to the sidewall 201 and of connecting the alignment piece 312 with the throw-off device 202 are possible.

Figure 2A:
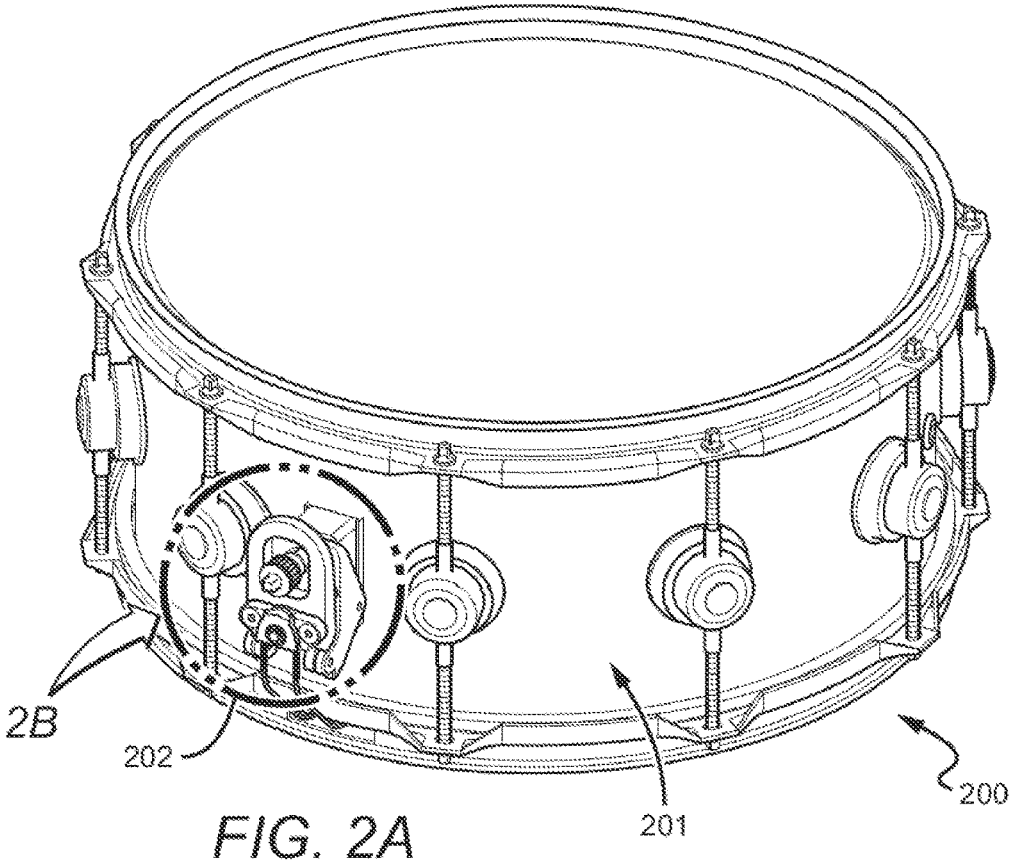
FIG. 2A is a perspective view of one embodiment of a drum according to the present disclosure.
Figure 2B:
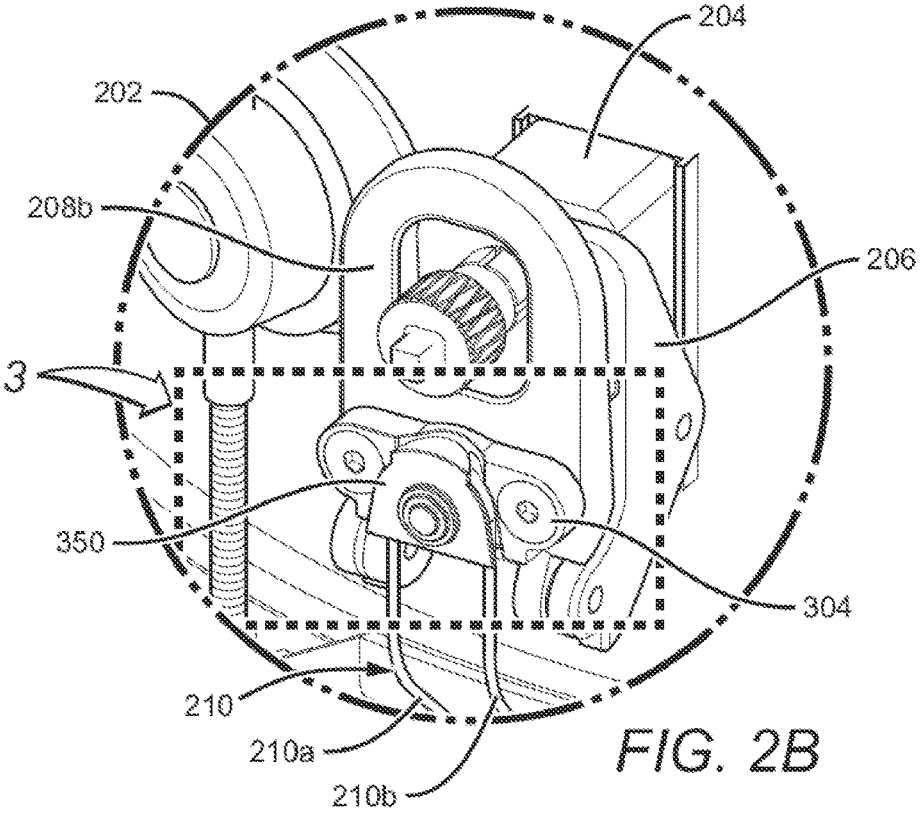
FIG. 2B is a magnified perspective view of a portion of the drum shown in FIG. 2A.
Figure 2C:
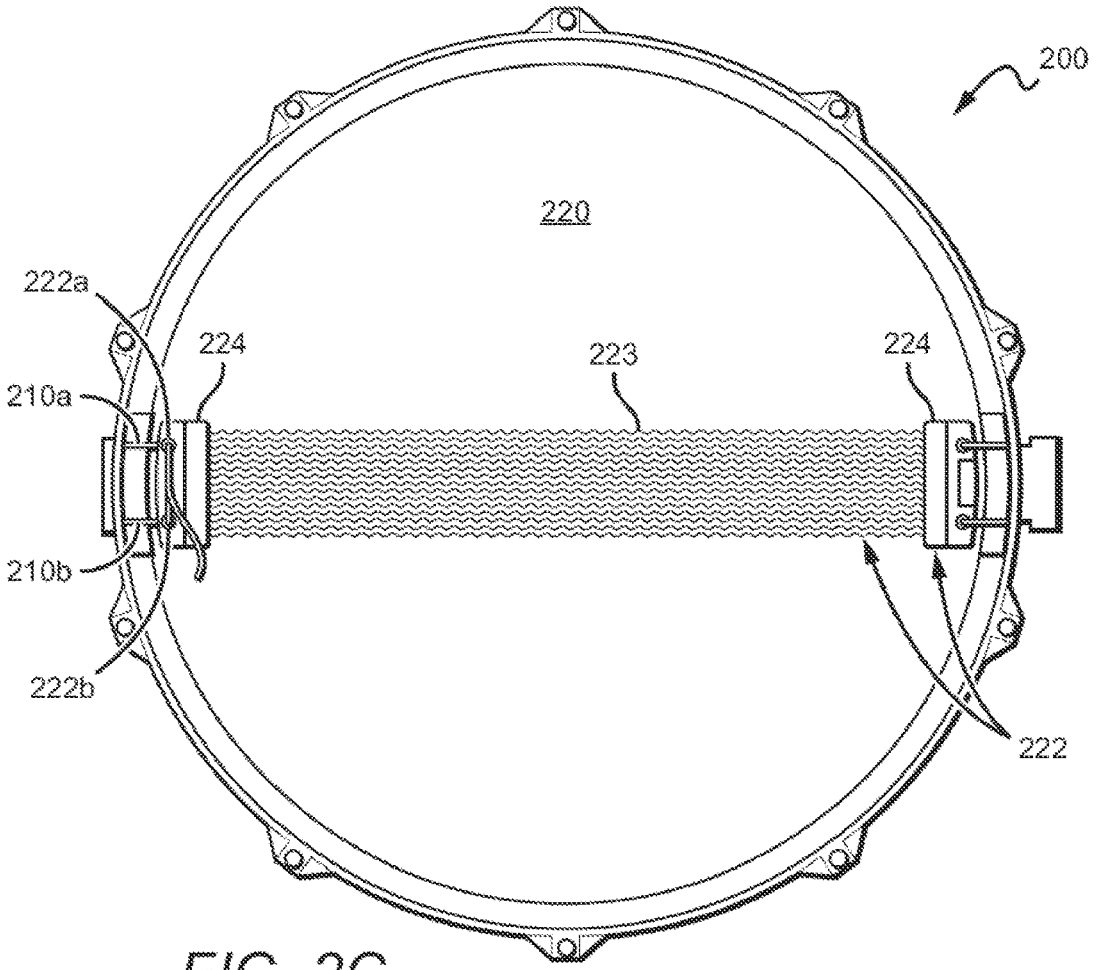
FIG. 2C is a bottom view of the drum shown in FIG. 2A.

The tensioning band 210 can connect to a snare 222, which can include snare wires 223 and a fitting 224 on each end of the snare wires 223, as best shown in FIG. 2C. The two tensioning band portions 210*a*,210*b* can connect to different portions 222*a*,222*b* of one of the fittings 222, and can connect to the fitting in a symmetric manner (e.g., the connection points 222*a*,222*b* can be approximately symmetrical with regard to the fitting 224). The alignment piece can be positioned approximately equidistant from and/or approximately symmetrical with regard to each of the connection points 222*a*,222*b*. In the specific embodiment shown the fitting portions 222*a*,222*b* comprise holes through which the tensioning band portions 210*a*,210*b* pass, although many other connection arrangements are possible, such as connections using fasteners, adhesives, and other connection means as known in the art. In the configuration shown in FIGS. 2A-2C, the throw-off handle 208*b* is in a first position, in this case an upward position, such that the snare wires 223 are proximate and/or in contact with the bottom drum head 220. As such, the tensioning band 210 and its portions 210*a*,210*b* are taut. Were the throw-off handle 208*b* placed in a second, downward position, the tensioning band 210 and its portions 210*a*,210*b* would be slack such that the snare wires 223 were no longer proximate and/or in contact with the bottom drum head 220.

In the specific configuration shown in FIG. 2C, the ends of the tensioning band portions 210*a*,210*b* are tied together. When discussing length of the portions, it is understood that this length should be measured from the aligning piece and/or alignment component to the connection point of the fitting, and these lengths should not include non-operative portions such as those portions which may be tied together after the connection points of the fitting. Other embodiments are also possible.

In prior art drums, tensioning bands are often crimped between two pieces such that the crimped portion cannot move or correct for tension and/or length differences between its halves. This prior art arrangement could result in one half of the tensioning band arrangement having a different tension, tautness, and/or length than the other half, resulting in a skewing of the positioning of the snare. For example, the snare may no longer be placed substantially across the diameter of the bottom drum head, or may be vertically misaligned such that some of the snare wires are proximate and/or in contact with the bottom drum head while others of the snare wires are not. These misalignments can occur, for example, if one portion of a tensioning band wears faster than another.

Figure 3:
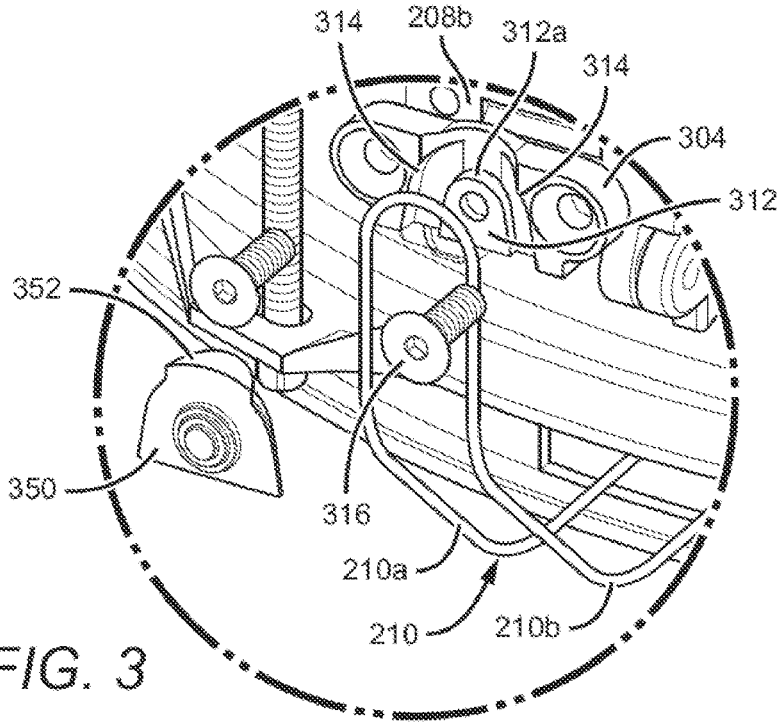
FIG. 3 is an exploded, magnified perspective view of a portion of the drum shown in FIG. 2A.

The drum 200 includes the alignment piece 312, shown best in the magnified view of FIG. 2B and the exploded view of FIG. 3, to correct for these prior art problems. The tensioning device 202 may include a portion thereof, such as a plate 304, which can comprise the alignment piece 312 or otherwise be attached to the alignment piece 312. The plate 304 may be integral to the remainder of the tensioning device 202, the remainder of the drum body, or otherwise attached to either. The alignment piece 312 may be shaped to accept a tensioning band 310 attached to the snare 222, and the tensioning band 310 may loop around the alignment piece 312 such that the alignment piece 312 changes the direction of the tensioning band 310. The alignment piece 312 can interact with the tensioning band 310 (including the portions 310*a*,310*b* thereof) such that the tension on each portion 310*a*,310*b* of the tensioning band 310 is equal or approximately equal, and/or such that the length of the portions 310*a*,310*b* between the alignment piece 312 and the snare 222 and/or fitting 224 is equal or approximately equal.

The alignment piece 312 can comprise a curved surface 312*a*. A curved surface such as the curved surface 312*a* is particularly adapted to allow for equalization of the tension in portions 310*a*,310*b* of the tensioning band 310 without necessitating adjustment by the user, referred to herein as "self-adjustment" or "self-correction." While the cross-section of the alignment piece 312 and curved surface 312*a* are shown with a substantially oval-type of curve (e.g., the alignment piece curved surface 312 is an oval segment), it is understood that many different shaped alignment pieces are possible, including alignment pieces with circle-type curves, or without curved portions or surfaces such as square surfaces or other non-curved surfaces.

A second member, such as a cover 350, can be used to secure the tensioning band 310 to the remainder of the drum body while also allowing for the previously-described self-adjustment. In the specific embodiment shown in FIG. 3, the cover 350 is shown as connectable to plate 304, which itself comprises the alignment piece 312. The cover 350 can be connected by any connection means known in the art, such as a connection using a fastener, a male/female connection, and/or a snap-fit connection to the plate 304 and/or alignment piece 312. Portions of the alignment piece 312 and/or cover 350 can help prevent accidental displacement of the tensioning band 310, while also allowing for the tensioning band 310 to self-adjust or self-correct. For example, in the specific embodiment shown the cover 350 includes a lip 352, which can be over a top of the tensioning band 310 when the tensioning band 310 is engaged with the alignment piece 312. Sidewalls such as sidewalls 314 can also be included to the sides of the alignment piece 312 which will also aid in preventing the accidental dislodging of the tensioning band 310. While in the specific embodiment shown the cover 314 includes the lip 352 and the plate 304 includes the sidewalls 350, it is understood that the cover 350 can include both a lip and sidewalls, the plate 304 can include both a lip and sidewalls, lips and sidewalls can be separate elements from both the cover 350 and the plate 304, or lips and sidewalls can be included as parts of other elements. The plate 304 and cover 350 can combine to form a slot or channel through which the tensioning band 310 can pass, such that the tensioning band 310 is passing between the plate 304 and the cover 350 and/or looping over the alignment piece 312.

Use of a cover separate from a plate, such as the cover 350 separate from the plate 304, has an advantage in that the tensioning band can be placed on the alignment piece 312 (whether that piece is part of the plate, part of the cover, or a separate component) prior to the plate 304 and cover 350 being joined, and the plate 304 and cover 350 can be designed such that the tensioning band does not disconnect while the two pieces are engaged. Such a connection may be difficult with a single-piece component, because a user will still need to be able to access the alignment piece so as to be able to place the tensioning band in engagement therewith, an arrangement which may also enable accidental disengagement of the tensioning band from the alignment piece. Such an arrangement may also cause the tensioning band to be unnecessarily stretched and cause wear when a user stretches the tensioning band to engage it with the alignment piece.

In other embodiments, a separate cover may not be included. For example, a plate can be shaped to define a cover and/or can be shaped to define a slot or channel through which a tensioning band may pass. In one such embodiment a first self-alignment component is included on a drum sidewall. The first self-alignment component can comprise a first alignment piece shaped to define a channel configured to be engaged by a first tensioning band attached to a snare, and further configured such that portions of the first tensioning band on opposing sides of said first alignment piece self-align to have approximately equal tension and/or length. This can have the advantage of having fewer pieces and reducing complexity. Many different embodiments are possible, and embodiments described in this paragraph may include other components similar to or the same as components described elsewhere herein.

The plate 304 can be attached to the tensioning device 202 and/or handle 208*b,* such as via fasteners 316 and/or via an adhesive. Alternatively the plate 304 may be attached to the sidewall of a drum or another element on a sidewall of a drum, or may be integral with the tensioning device 202, handle 208*b,* drum sidewall, or another element on a sidewall of a drum.

Alignment pieces according to the present disclosure, such as the alignment piece 312, can take many different forms and be formed of many different materials. For instance, alignment pieces according to the present disclosure can include protrusions, posts, movable or stationary pulley devices, rotary devices, circular devices, oval-shaped devices, and devices of many shapes. In one embodiment a movable surface (such as a rotatable pulley surface) can be used. Alignment pieces can be made of metal, wood, composite materials, plastic, and/or many other materials, and/or combinations thereof.

Figure 4A:
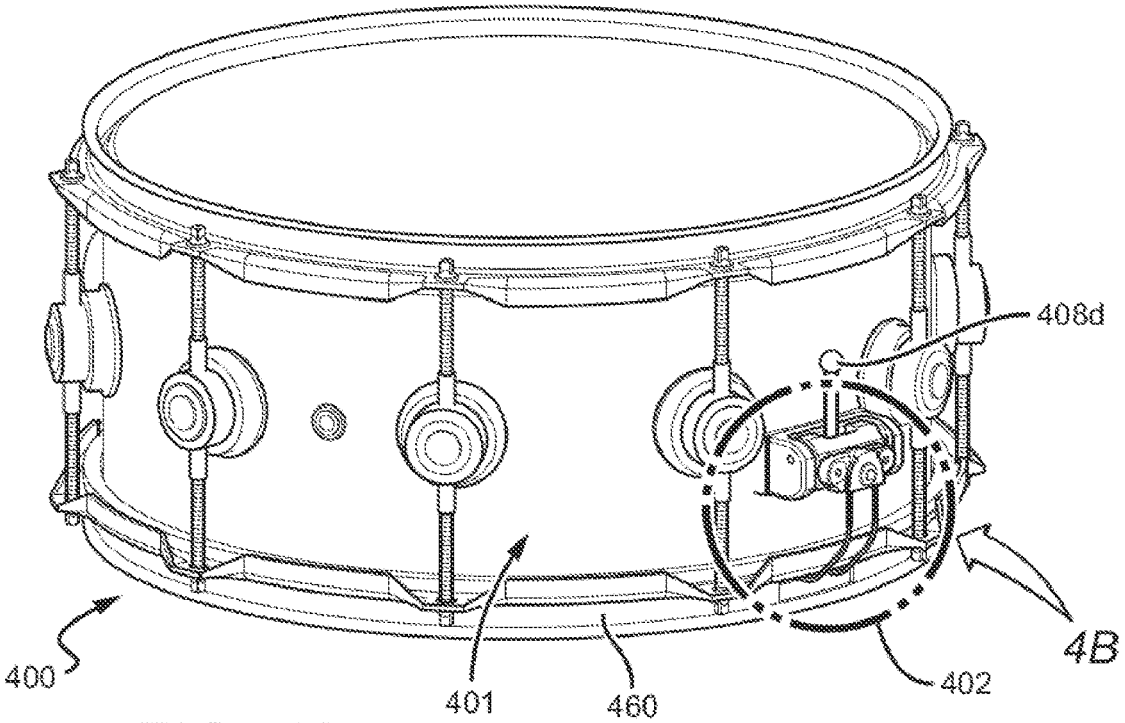
FIG. 4A is a perspective view of one embodiment of a drum according to the present disclosure.
Figure 4B:
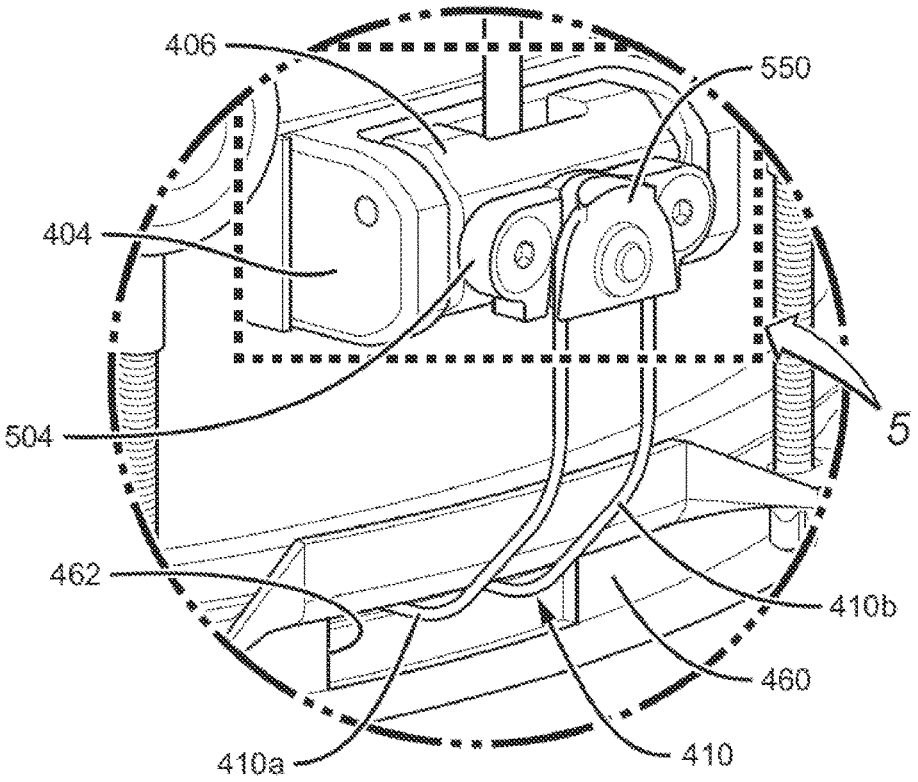
FIG. 4B is a magnified perspective view of a portion of the drum shown in FIG. 4A.
Figure 5:
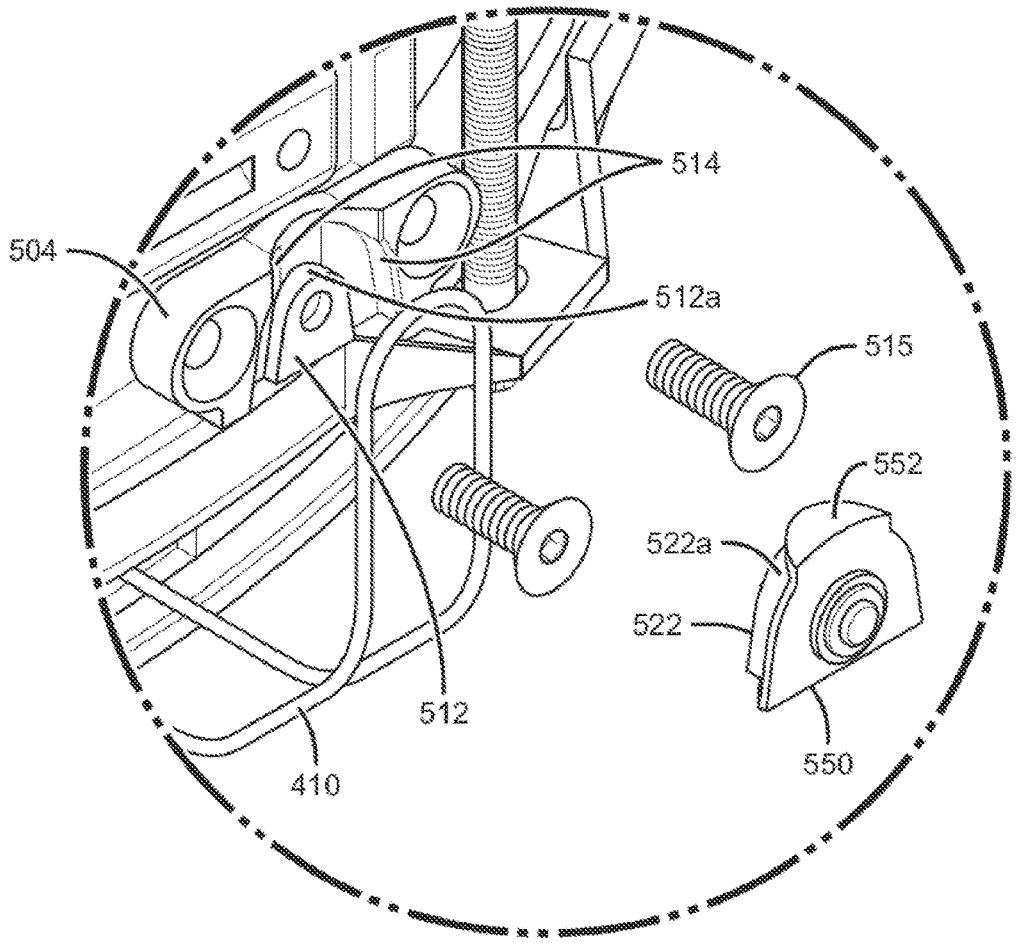
FIG. 5 is an exploded, magnified perspective view of a portion of the drum shown in FIG. 4A.

While the embodiment described above with regard to FIGS. 2A-3 includes devices used in conjunction with a throw-off device, these self-alignment components and methods can also be utilized with other types of devices. For example, FIGS. 4A, 4B, and 5 show perspective, magnified perspective, and magnified exploded perspective views of a drum 400 according to one embodiment of the present disclosure (the bottom view thereof can be substantially similar to or the same as the bottom view of FIG. 2C). The drum 400 can include a sidewall 402 and a 3-position or continuous tensioning device 402, such as those devices described in commonly owned U.S. Pat. No. 8,143,507 to Good et al. As more fully described therein, a portion 406 is pivotally connected to a mount portion 404, and adjustment of the lever 408*d* can cause the portion 406 to be slightly more upwardly angled (causing more tension on the tensioning band 410 and more contact between the snare wires and bottom drum head) or to be slightly more downwardly angled (such that there is less tension on the tensioning band 410 and slightly less contact between the snare wires and bottom drum head).

The self-alignment system of the drum 400 can contain many components similar to or the same as the system of the drum 200 from FIGS. 2A-3. For example, the tensioning band 410 and tensioning band portions 410*a*,410*b* can be similar to or the same as the tensioning band 210 and tensioning band portions 210*a*,210*b;* the plate 504 can be similar to or the same as the plate 304; the sidewalls 514 can be similar to or the same as the sidewalls 314; and/or connectors 516 can be similar to or the same as the fasteners 316. The cover 550 can be similar to or the same as the cover 350, although in this embodiment it is different. In the embodiment best seen in FIG. 5, the cover 550 includes a lip 552 similar to or the same as the lip 352. The cover 550 also includes an alignment piece 522 that fits over the cover alignment piece 512 with curved surface 512*a*, such that the tensioning band will engage the curved surface 522*a* of the alignment piece 522. That is to say, in some embodiments instead of the tensioning band engaging an alignment piece attached to the sidewall of the drum, the tensioning band will engage an alignment piece that is attached to or part of the cover. Other embodiments, such as where the tensioning band engages an alignment piece attached to the sidewall of the drum, are possible. It is understood that no matter the tensioning device (e.g., throw-off or 3-position tensioning device), and in embodiments not including a tensioning device, any combination of alignment piece styles (e.g., attached to or integral with drum-side as in FIGS. 2A-3, or attached to or integral with cover-side as in FIGS. 4A-5) is possible.

Tensioning bands used in embodiments of the present disclosure, such as the tensioning band 410, can pass through apertures in a bottom drum rim. For example, as best shown in FIG. 4B, the tensioning band passes through an aperture 462 in a bottom drum rim 460 in order to reach the bottom drum head (not shown). The bottom view of the drum 400 is not shown but can be substantially similar to or the same as that of the drum 200, with the tensioning band connecting to a snare fitting in a substantially similar manner or the same manner as previously described and shown. Other arrangements are possible, and apertures, if present, can be in many different locations.

While the embodiments described above with regard to FIGS. 2A-5 describe devices used in conjunction with different tensioning devices, it is understood that these tensioning devices need not necessarily be present to employ the self-alignment features described herein. For example, in drums without such tensioning devices the self-alignment features can be connected to and/or part of a drum sidewall, and similar tensioning band arrangements between alignment pieces and snares can be employed. Many different embodiments are possible. Further, any combination of self-alignment systems can be used on opposing sides of a drum such that tensioning bands on both sides of the snare can be self-aligning. Many different embodiments are possible as would be understood by one of skill in the art.

Figure 6:
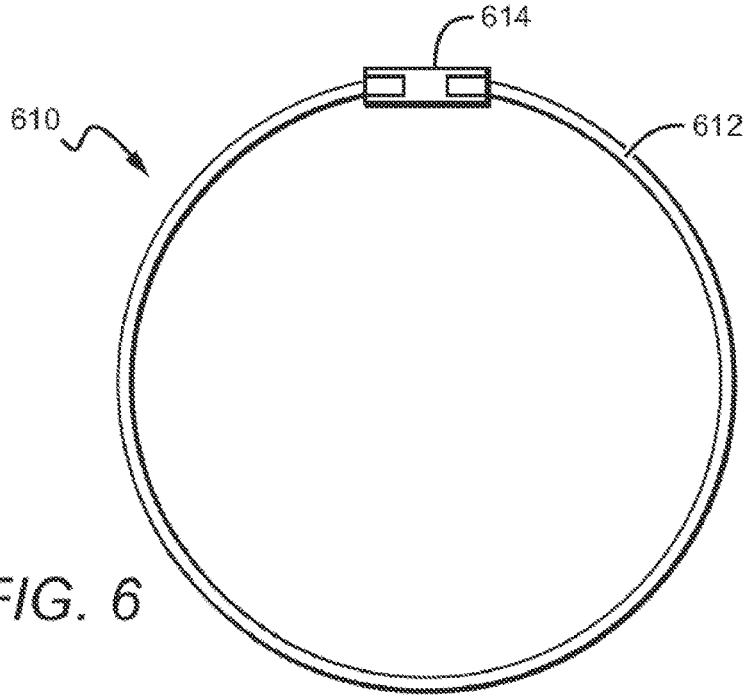
FIG. 6 is a side view of one embodiment of a tensioning band according to the present disclosure.

Further, many different styles of tensioning bands are possible. In some embodiments, an elastic material is used, which can provide increased tension over non-elastic materials, which can be desirable in certain applications. Tensioning bands such as the tensioning bands 210,410 can include, for example, rubber, elastic, parachute cord, nylon, rope, cord, and/or other similar materials. Tensioning bands can also include other components. For example, FIG. 6 shows a tensioning band 610 which includes a band portion 612 and a crimp portion 614, which can be a metal crimp portion, although other materials such as plastics, composites, etc., and combinations of materials, are also possible. The crimp portion 614 can, for example, be engaged with an alignment piece and/or an alignment piece's curved surface, or a portion of the band portion 612 can be engaged with the alignment piece and/or alignment piece's curved surface. In one embodiment, the crimp portion is on the side of the connection points opposite the alignment piece so as to connect the tensioning band portions (as opposed to tying the portions together as shown in FIG. 2C). Many different embodiments are possible.

In an alternative embodiment of the present disclosure, the drum sidewall itself is shaped to define and/or comprises a self-alignment component. For example, the drum sidewall can comprise or be shaped to define a channel configured to be engaged by a first tensioning band attached to a snare and further configured such that portions of said first tensioning band on opposing sides of said channel self-align to have approximately equal tension and/or length. Such embodiments can include other components similar to or the same as those previously described herein.

Further, other manners of achieving self-alignment/self-correction are possible. For instance, in one embodiment a device includes two tensioning band portions that are not integral/connected with one another, but instead both attach to self-alignment component that can rotate, pivot, or seesaw so as to correct the position of the snare, tension of the tensioning band portions, and/or length of the tensioning band portions. In yet another embodiment. In yet another embodiment, two spring-loaded pistons are utilized to keep two separate tensioning band portions appropriately tensioned. Many different embodiments are possible.

It is understood that embodiments presented herein are meant to be exemplary. Embodiments of the present disclosure can comprise any combination of compatible features shown in the various figures, and these embodiments should not be limited to those expressly illustrated and discussed.

Although the present disclosure has been described in detail with reference to certain preferred configurations thereof, other versions are possible. Therefore, the spirit and scope of the disclosure should not be limited to the versions described above.

The foregoing is intended to cover all modifications and alternative constructions falling within the spirit and scope of the disclosure as expressed in the appended claims, wherein no portion of the disclosure is intended, expressly or implicitly, to be dedicated to the public domain if not set forth in the claims.

I claim:

1. A percussion instrument, comprising:

a top drum head;

a bottom drum head;

a drum sidewall connecting said top drum head to said bottom drum head;

a snare comprising first and second fittings and a plurality of snare wires, each of said snare wires having a first end attached to said first fitting and a second end attached to said second fitting, said snare wires configured to be in contact with said bottom drum head such that said snare wires vibrate when said top drum head is actuated by a user, said first fitting comprising a first band connection point and a second band connection point;

a self-alignment component on said drum sidewall, said self-alignment component comprising:

a plate; and a cover attached to said plate;

wherein one of said plate and said cover comprises an alignment piece; and a tensioning band connecting said self-alignment component to said first fitting at said first band connection point and at said second band connection point, said tensioning band running continuously from said first band connection point, looping over said alignment piece, to said second band connection point, said tensioning band passing between said plate and said cover while looping over said alignment piece.

2. The percussion instrument of claim 1, wherein said alignment piece comprises a curved surface, and wherein said tensioning band engages said curved surface.

3. The percussion instrument of claim 1, wherein said curved surface is movable.

4. The percussion instrument of claim 1, further comprising a tensioning device between said drum sidewall and said self-alignment component, said self-alignment component on said tensioning device.

5. The percussion instrument of claim 4, wherein said tensioning device is a throw-off.

6. The percussion instrument of claim 4, wherein said tensioning device comprises a mount portion and a second portion pivotally mounted to said mount portion;

wherein said self-alignment component is on said second portion of said tensioning device; and wherein said second portion of said tensioning device is configured to pivot between a first position and a second position, said first position more upwardly angled than said second position such that said tensioning band is more taut when said second portion of said tensioning device is in said first position than when said second portion of said tensioning device is in said second position.

7. The percussion instrument of claim 1, wherein said tensioning band comprises a first portion between said first band connection point and said alignment piece, and further comprises a second portion between said second band connection point and said alignment piece, said first portion integral with said second portion and meeting said second portion at said alignment piece.

8. The percussion instrument of claim 7, wherein the length of said first portion is approximately equal to the length of said second portion.

9. The percussion instrument of claim 1, wherein said first band connection point and said second band connection point are symmetrically located on said first fitting.

10. The percussion instrument of claim 1, wherein said tensioning band is engaged with said self-alignment component so as to be biased to move toward a position wherein two portions of said tensioning band on opposite sides of said self-alignment component and between said self-alignment component and said snare are equally tensioned.

11. The percussion instrument of claim 1, wherein said alignment piece is a protrusion of said cover.

12. The percussion instrument of claim 1, wherein said alignment piece is a protrusion of said plate.

13. The percussion instrument of claim 1, wherein said cover comprises a lip at least partially over said alignment piece.

14. The percussion instrument of claim 1, wherein said plate comprises a sidewall to each side of said alignment piece.

15. The percussion instrument of claim 1, wherein said self-alignment component is a first self-alignment component and said tensioning band is a first tensioning band, and further comprising:

a second self-alignment component on said drum sidewall substantially opposite said first self-alignment component, said second self-alignment component comprising:

a second plate; and a second cover attached to said second plate;

wherein one of said second plate and said second cover comprises a second alignment piece; and a second tensioning band connecting said second self-alignment component to said snare;

wherein said second fitting comprises a third band connection point and a fourth band connection point, said second tensioning band connected to said second fitting at said third band connection point and connected to said second fitting at said fourth band connection point, said second tensioning band running continuously from said third band connection point, looping over said second alignment piece, to said fourth band connection point, said second tensioning band passing between said second plate and said second cover while looping over said second alignment piece.

16. A percussion instrument, comprising:

a drum sidewall; and a first self-alignment component attached to said drum sidewall, said first self-alignment component comprising a first alignment piece comprising a first surface, said first surface configured to be engaged by a first tensioning band attached to a snare at a first connection point and a second connection point with the first tensioning band running from said first connection point, over said first alignment piece, to said second connection point, and configured such that portions of said first tensioning band on opposing sides of said first alignment piece and between said first alignment piece and said snare self-align about said first alignment piece to have approximately equal tension and/or equal length;

wherein said first self-alignment component comprises a plate and a cover, one of said plate and said cover comprising said first alignment piece; and wherein at least a front of said plate, a rear of said cover, and said first surface combine to form a channel configured such that said first tensioning band passes through said channel when looping over said first alignment piece and engaging said first surface.

17. The percussion instrument of claim 16, wherein said first surface is a first curved surface.

18. The percussion instrument of claim 17, further comprising a second self-alignment component attached to said drum sidewall at a point substantially opposite said first self-alignment component, said second self-alignment component comprising a second alignment piece comprising a second curved surface, said second curved surface configured to be engaged by a second tensioning band attached to said snare and configured such that portions of said second tensioning band on opposing sides of said second alignment piece and between said second alignment piece and said snare self-align to have approximately equal tension and/or equal length.

19. The percussion instrument of claim 16, wherein said cover comprises said first alignment piece.

20. The percussion instrument of claim 16, further comprising said first tensioning band and said snare.

21. A percussion instrument, comprising:

a top drum head;

a bottom drum head;

a drum sidewall connecting said top drum head to said bottom drum head;

a snare configured to be in contact with said bottom drum head;

a self-alignment component on said drum sidewall, and a tensioning band connecting said self-alignment component to said snare at first and second connection points of said snare, wherein said tensioning band runs continuously from said first connection point of said snare to said second connection point of said snare and loops over said self-alignment component on the way from said first connection point of said snare to said second connection point of said snare, said tensioning band comprising a first tensioning band portion on a first side of said self-alignment component and a second tensioning band portion on a second side of said self-alignment component, said first tensioning band portion integral with said second tensioning band portion;

wherein said self-alignment component and said tensioning band are configured such that said first and second tensioning band portions self-adjust so as to have approximately equal tension and/or length.

22. The percussion instrument of claim 21, wherein said tensioning band loops over said self-alignment component at a point equidistant from said first and second connection points of said snare.

23. The percussion instrument of claim 21, wherein said self-alignment component is a first self-alignment component and said tensioning band is a first tensioning band, and further comprising:

a second self-alignment component on said drum sidewall substantially opposite said first self-alignment component; and a second tensioning band connecting said second self-alignment component to said snare at third and fourth connection points of said snare, wherein said second tensioning band runs continuously from said third connection point of said snare to said fourth connection point of said snare and loops over said second self-alignment component on the way from said third connection point of said snare to said fourth connection point of said snare, said second tensioning band comprising a third tensioning band portion on a first side of said second self-alignment component and a fourth tensioning band portion on a second side of said second self-alignment component, said third tensioning band portion integral with said fourth tensioning band portion;

wherein said second self-alignment component and said second tensioning band are configured such that said third and fourth tensioning band portions self-adjust so as to have approximately equal tension and/or length.

* * * * *